US009414455B2

(12) United States Patent
Zhou et al.

(10) Patent No.: US 9,414,455 B2
(45) **Date of Patent: *Aug. 9, 2016**

(54) SYSTEMS AND METHODS FOR DIMMING CONTROL WITH CAPACITIVE LOADS

(71) Applicant: ON-BRIGHT ELECTRONICS (SHANGHAI) CO., LTD., Shanghai (CN)

(72) Inventors: Jun Zhou, Shanghai (CN); Zhongliang Xiong, Shanghai (CN); Miao Li, Shanghai (CN); Yaming Cao, Shanghai (CN); Qiang Luo, Shanghai (CN); Lieyi Fang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/562,432

(22) Filed: Dec. 5, 2014

(65) Prior Publication Data

US 2015/0091470 A1 Apr. 2, 2015

Related U.S. Application Data

(63) Continuation of application No. 13/105,780, filed on May 11, 2011, now Pat. No. 8,941,324.

(30) Foreign Application Priority Data

Apr. 22, 2011 (CN) ..... 2011 1 0103130

(51) Int. Cl.
*H05B 37/02* (2006.01)
*H05B 33/08* (2006.01)

(52) U.S. Cl.
CPC ..... *H05B 33/0845* (2013.01); *H05B 33/0815* (2013.01); *H05B 33/0851* (2013.01); *H05B 37/02* (2013.01)

(58) Field of Classification Search
CPC ..... H05B 33/08; H05B 37/02
USPC ..... 315/209 R, 219, 224–226, 246, 247, 315/250, 291, 294, 297, 307
See application file for complete search history.

(56) References Cited

U.S. PATENT DOCUMENTS 3,803,452 A 4/1974 Goldschmied
4,253,045 A 2/1981 Weber (Continued)

FOREIGN PATENT DOCUMENTS

CN 1448005 A 10/2003
CN 101657057 A 2/2010

(Continued)

OTHER PUBLICATIONS

China Patent Office, Office Action mailed Nov. 15, 2014, in Application No. 201210166672.0.

(Continued)

*Primary Examiner* — Tung X Le
(74) *Attorney, Agent, or Firm* — Jones Day

(57) ABSTRACT

System and method for dimming control. The system includes a system controller including a first controller terminal and a second controller terminal, a transistor including a first transistor terminal, a second transistor terminal and a third transistor terminal, and a resistor including a first resistor terminal and a second resistor terminal. The system controller is configured to generate a first signal at the first controller terminal based on an input signal and to generate a second signal at the second controller terminal based on the first signal. The first transistor terminal is coupled to the second controller terminal. The first resistor terminal is coupled to the second transistor terminal. The second resistor terminal is coupled to the third transistor terminal. The transistor is configured to receive the second signal at the first transistor terminal and to change between two conditions in response to the second signal.

47 Claims, 11 Drawing Sheets

(56) References Cited

U.S. PATENT DOCUMENTS

| | | | | |
|---|---|---|---|---|
| 5,144,205 | A | 9/1992 | Motto et al. | |
| 5,949,197 | A | 9/1999 | Kastner | |
| 6,218,788 | B1 | 4/2001 | Chen et al. | |
| 6,229,271 | B1 | 5/2001 | Liu | |
| 7,038,399 | B2 | 5/2006 | Lys et al. | |
| 7,649,327 | B2 * | 1/2010 | Peng | 315/312 |
| 7,880,400 | B2 | 2/2011 | Zhou et al. | |
| 7,944,153 | B2 * | 5/2011 | Greenfeld | H05B 33/0851 315/224 |
| 8,134,302 | B2 | 3/2012 | Yang et al. | |
| 8,278,832 | B2 | 10/2012 | Hung et al. | |
| 8,378,583 | B2 | 2/2013 | Hying et al. | |
| 8,378,588 | B2 | 2/2013 | Kuo et al. | |
| 8,378,589 | B2 | 2/2013 | Kuo et al. | |
| 8,432,438 | B2 | 4/2013 | Ryan et al. | |
| 8,497,637 | B2 | 7/2013 | Liu | |
| 8,644,041 | B2 | 2/2014 | Pansier | |
| 8,698,419 | B2 | 4/2014 | Yan et al. | |
| 8,890,440 | B2 | 11/2014 | Yan et al. | |
| 8,941,324 | B2 | 1/2015 | Zhou et al. | |
| 9,030,122 | B2 | 5/2015 | Yan et al. | |
| 9,220,136 | B2 | 12/2015 | Zhang | |
| 2006/0022648 | A1 | 2/2006 | Ben-Yaakov et al. | |
| 2007/0182699 | A1 * | 8/2007 | Ha | G09G 3/3413 345/102 |
| 2007/0267978 | A1 | 11/2007 | Shteynberg et al. | |
| 2008/0224629 | A1 | 9/2008 | Melanson | |
| 2008/0278092 | A1 * | 11/2008 | Lys | H05B 33/0815 315/247 |
| 2009/0021469 | A1 | 1/2009 | Yeo et al. | |
| 2009/0251059 | A1 | 10/2009 | Veltman | |
| 2010/0164406 | A1 | 7/2010 | Kost et al. | |
| 2010/0176733 | A1 | 7/2010 | King | |
| 2010/0207536 | A1 * | 8/2010 | Burdalski | H05B 33/0818 315/224 |
| 2010/0213859 | A1 | 8/2010 | Shteynberg | |
| 2011/0037399 | A1 * | 2/2011 | Hung et al. | 315/219 |
| 2011/0080110 | A1 | 4/2011 | Nuhfer et al. | |
| 2011/0080111 | A1 | 4/2011 | Nuhfer et al. | |
| 2011/0121744 | A1 | 5/2011 | Salvestrini | |
| 2011/0227490 | A1 | 9/2011 | Huynh | |
| 2011/0260619 | A1 | 10/2011 | Sadwick | |
| 2011/0285301 | A1 | 11/2011 | Kuang et al. | |
| 2011/0291583 | A1 | 12/2011 | Shen | |
| 2011/0309759 | A1 | 12/2011 | Shteynberg | |
| 2012/0032604 | A1 | 2/2012 | Hontele | |
| 2012/0146526 | A1 | 6/2012 | Lam et al. | |
| 2012/0181946 | A1 | 7/2012 | Melanson | |
| 2012/0268031 | A1 | 10/2012 | Zhou et al. | |
| 2012/0299500 | A1 | 11/2012 | Sadwick | |
| 2012/0299501 | A1 | 11/2012 | Kost et al. | |
| 2012/0326616 | A1 | 12/2012 | Sumitani et al. | |
| 2013/0009561 | A1 | 1/2013 | Briggs | |
| 2013/0020965 | A1 | 1/2013 | Kang et al. | |
| 2013/0026942 | A1 | 1/2013 | Ryan et al. | |
| 2013/0026945 | A1 | 1/2013 | Ganick et al. | |
| 2013/0027528 | A1 | 1/2013 | Staats et al. | |
| 2013/0063047 | A1 | 3/2013 | Veskovic | |
| 2013/0175931 | A1 | 7/2013 | Sadwick | |
| 2013/0181630 | A1 | 7/2013 | Taipale et al. | |
| 2013/0193879 | A1 | 8/2013 | Sadwick | |
| 2013/0215655 | A1 | 8/2013 | Yang et al. | |
| 2013/0223107 | A1 | 8/2013 | Zhang et al. | |
| 2013/0241427 | A1 | 9/2013 | Kesterson et al. | |
| 2013/0241428 | A1 | 9/2013 | Takeda | |
| 2013/0242622 | A1 | 9/2013 | Peng | |
| 2013/0307431 | A1 | 11/2013 | Zhu et al. | |
| 2013/0307434 | A1 | 11/2013 | Zhang | |
| 2014/0029315 | A1 | 1/2014 | Zhang et al. | |
| 2014/0063857 | A1 | 3/2014 | Peng | |
| 2014/0078790 | A1 | 3/2014 | Lin et al. | |
| 2014/0103829 | A1 | 4/2014 | Kang | |
| 2014/0132172 | A1 | 5/2014 | Zhu et al. | |
| 2014/0160809 | A1 | 6/2014 | Lin et al. | |
| 2014/0265935 | A1 | 9/2014 | Sadwick | |
| 2014/0346973 | A1 | 11/2014 | Zhu et al. | |
| 2014/0354170 | A1 | 12/2014 | Gredler | |
| 2015/0077009 | A1 | 3/2015 | Kunimatsu | |
| 2015/0312988 | A1 | 10/2015 | Liao et al. | |
| 2016/0014861 | A1 | 1/2016 | Zhu et al. | |
| 2016/0014865 | A1 | 1/2016 | Zhu et al. | |

FOREIGN PATENT DOCUMENTS

| | | | |
|---|---|---|---|
| CN | 101868090 | | 10/2010 |
| CN | 101896022 | A | 11/2010 |
| CN | 101917804 | A | 12/2010 |
| CN | 101998734 | A | 3/2011 |
| CN | 102014551 | A | 4/2011 |
| CN | 102056378 | A | 5/2011 |
| CN | 102209412 | A | 10/2011 |
| CN | 102300375 | A | 12/2011 |
| CN | 102347607 | | 2/2012 |
| CN | 102387634 | A | 3/2012 |
| CN | 103004290 | | 3/2012 |
| CN | 102474953 | | 5/2012 |
| CN | 102497706 | | 6/2012 |
| CN | 202353859 | U | 7/2012 |
| CN | 102695330 | A | 9/2012 |
| CN | 102791056 | A | 11/2012 |
| CN | 102843836 | A | 12/2012 |
| CN | 202632722 | U | 12/2012 |
| CN | 102870497 | | 1/2013 |
| CN | 102946674 | A | 2/2013 |
| CN | 103024994 | A | 4/2013 |
| CN | 103313472 | | 9/2013 |
| CN | 103369802 | A | 10/2013 |
| CN | 103379712 | A | 10/2013 |
| CN | 103547014 | | 1/2014 |
| CN | 103716934 | | 4/2014 |
| CN | 103858524 | | 6/2014 |
| CN | 103945614 | A | 7/2014 |
| EP | 2403318 | A1 | 1/2012 |
| JP | 2008-010152 | A | 1/2008 |
| JP | 2011-249328 | A | 12/2011 |
| TW | 201215228 | A1 | 9/2010 |
| TW | 201125441 | A | 7/2011 |
| TW | 201132241 | | 9/2011 |
| TW | 201143530 | A | 12/2011 |
| TW | 201146087 | A1 | 12/2011 |
| TW | 201208463 | A1 | 2/2012 |
| TW | 201208481 | A1 | 2/2012 |
| TW | 201208486 | | 2/2012 |
| TW | I 387396 | | 2/2013 |
| TW | 201322825 | A | 6/2013 |
| TW | 201342987 | | 10/2013 |
| TW | I 423732 | | 1/2014 |
| TW | 201412189 | A | 3/2014 |
| TW | M477115 | | 4/2014 |
| TW | 201417626 | A | 5/2014 |
| TW | 201417631 | | 5/2014 |
| TW | 201422045 | | 6/2014 |
| TW | 201424454 | A | 6/2014 |
| TW | I448198 | | 8/2014 |

OTHER PUBLICATIONS

China Patent Office, Office Action mailed Jul. 7, 2014, in Application No. 201210468505.1.

China Patent Office, Office Action mailed Jun. 3, 2014, in Application No. 201110103130.4.

Taiwan Intellectual Property Office, Office Action mailed Jan. 7, 2014, in Application No. 100119272.

Taiwan Intellectual Property Office, Office Action mailed Jun. 9, 2014, in Application No. 101124982.

Taiwan Intellectual Property Office, Office Action mailed Sep. 25, 2014, in Application No. 101148716.

United States Patent and Trademark Office, Notice of Allowanced mailed Apr. 9, 2015, in U.S. Appl. No. 13/527,475.

United States Patent and Trademark Office, Office Action mailed Dec. 2, 2014, in U.S. Appl. No. 13/527,475.

China Patent Office, Office Action mailed Jun. 30, 2015, in Application No. 201410171893.6.

(56) References Cited

OTHER PUBLICATIONS

China Patent Office, Office Action mailed Aug. 8, 2015, in Application No. 201410172086.6.
United States Patent and Trademark Office, Notice of Allowance mailed May 7, 2015, in U.S. Appl. No. 13/527,475.
United States Patent and Trademark Office, Office Action mailed Jun. 5, 2015, in U.S. Appl. No. 13/710,277.
China Patent Office, Office Action mailed Aug. 28, 2015, in Application No. 201410322602.9.
China Patent Office, Office Action mailed Mar. 2, 2016, in Application No. 201410172086.6.
China Patent Office, Office Action mailed Dec. 14, 2015, in Application No. 201210166672.0.
China Patent Office, Office Action mailed Oct. 19, 2015, in Application No. 201410322612.2.
Taiwan Intellectual Property Office, Office Action mailed Nov. 13, 2015, in Application No. 103141628.
Taiwan Intellectual Property Office, Office Action mailed Sep. 17, 2015, in Application No. 103127108.
Taiwan Intellectual Property Office, Office Action mailed Sep. 17, 2015, in Application No. 103127620.
United States Patent and Trademark Office, Notice of Allowance mailed Oct. 22, 2015, in U.S. Appl. No. 13/527,475.
United States Patent and Trademark Office, Notice of Allowance mailed Mar. 7, 2016, in U.S. Appl. No. 13/710,277.
United States Patent and Trademark Office, Notice of Allowance mailed Dec. 21, 2015, in U.S. Appl. No. 13/710,277.
United States Patent and Trademark Office, Office Action mailed Jan. 13, 2016, in U.S. Appl. No. 14/451,656.
United States Patent and Trademark Office, Office Action mailed Dec. 17, 2015, in U.S. Appl. No. 14/459,167.
United States Patent and Trademark Office, Office Action mailed Dec. 30, 2015, in U.S. Appl. No. 14/593,734.
United States Patent and Trademark Office, Office Action mailed Dec. 3, 2015, in U.S. Appl. No. 14/819,200.
China Patent Office, Office Action mailed Mar. 3, 2016, in Application No. 201410322612.2.
Taiwan Intellectual Property Office, Office Action mailed Apr. 18, 2016, in Application No. 103140989.

* cited by examiner

SYSTEMS AND METHODS FOR DIMMING CONTROL WITH CAPACITIVE LOADS

1. CROSS-REFERENCES TO RELATED APPLICATIONS

This application is a continuation of U.S. patent application Ser. No. 13/105,780, filed May 11, 2011, which claims priority to Chinese Patent Application No. 201110103130.4, filed Apr. 22, 2011, both of the above-referenced applications being commonly assigned and incorporated by reference herein for all purposes.

2. BACKGROUND OF THE INVENTION

The present invention is directed to integrated circuits. More particularly, the invention provides systems and methods for dimming control. Merely by way of example, the invention has been applied for dimming control using a light dimmer with capacitive loads. But it would be recognized that the invention has a much broader range of applicability.

Light emitting diodes (LEDs) have been widely used in various electronics applications, such as architectural lighting, automotive lighting, and backlighting of liquid crystal display (LCD). LEDs have been recognized to have significant advantages over other lighting sources, such as incandescent lamps, and the advantages include at least high efficiency and long lifetime. But, significant challenges remain for LEDs to widely replace incandescent lamps. The LED light systems need to be made compatible with conventional light dimmers that often operate with a phase-cut dimming method, such as leading edge dimming or trailing edge dimming.

Specifically, a conventional light dimmer usually includes a Triode for Alternating Current (TRIAC), and is used to drive pure resistive loads, such as incandescent lamps. But such conventional light dimmer may not function properly when connected to capacitive loads, such as LEDs and/or associated circuits. When the light dimmer starts conduction, internal inductance of the light dimmer and the capacitive loads may cause low frequency oscillation. Hence, the Alternate Current (AC) waveforms of the light dimmer often becomes unstable, resulting in flickering, undesirable audible noise, and/or even damages to other system components. FIG. 1 shows simplified signal waveforms of a conventional light dimmer that is connected to capacitive loads. The waveform 110 represents a rectified input waveform, and the waveform 120 represents a signal generated from a light dimmer.

In attempt to solve the above problems in using a conventional light dimmer with capacitive loads such as LEDs and/or associated circuits, a power resistor (e.g., with a resistance of several hundred Ohms) may be connected in series in an AC loop to dampen initial current surge when the light dimmer starts conduction.

FIG. 2 is a simplified diagram of a conventional light dimmer circuit. The light dimmer circuit 200 includes an AC input 210, a light dimmer 220, a capacitive load 230, and a power resistor 240. Additionally, FIG. 3 shows simplified conventional signal waveforms of the light dimmer circuit 200. As shown in FIGS. 2 and 3, the waveform 310 represents a rectified input signal received by the light dimmer 220. In response, the light dimmer 220 generates an output signal that is represented by the waveform 320 and received by the capacitive load 230. Comparing the waveforms of FIG. 3 with those in FIG. 1, using the resistor 240 in the light dimmer circuit 200 can reduce low frequency oscillation. But, for the light dimmer circuit 200, a current would flow through the resistor 240 even under normal working conditions, causing excessive heating of resistor and other system components. Such heating often leads to low efficiency and high energy consumption.

Therefore, some conventional techniques would short the power resistor through peripheral circuits when the AC input is stabilized after a light dimmer conducts for a predetermined period of time. FIG. 4 is a simplified conventional diagram showing a system for dimming control. As an example, a TRIAC (not shown in FIG. 4) is used as a light dimmer. The system 400 includes input terminals 422 and 424, a capacitor 430, a TRIAC dimming control circuit 440, and output terminals 452, 454. The TRIAC dimming control circuit 440 includes a power transistor 460, and resistors 472, 474, 476 and 478. As shown in FIG. 4, the TRIAC sends an input signal 410 to the input terminals 422 and 424. When the TRIAC is turned off, there is no input signal 410. In response, the transistor 460 is turned off by the voltage divider including the resistors 472, 474 and 476. When the TRIAC is turned on, the transistor 460 remains off, but the resistor 478 can dampen an initial surge current. After a predetermined period of time, the transistor 460 is turned on, and hence the resistor 478 is shorted. Therefore, the above noted approach can improve the system efficiency.

But the system 400 still suffers from significant deficiencies. For example, in a BUCK topology, when the TRIAC is turned off, the voltage on the capacitor 430 may not become lower than the output voltage (e.g., VOUT) at output terminals 452 and 454. If the output voltage and/or the threshold voltage of the transistor 460 changes, the transistor 460 may not be turned off properly and thus the resistor 478 may always be shorted. Thus, the system 400 would not operate properly under these circumstances.

Hence it is highly desirable to improve techniques of dimming control.

3. BRIEF SUMMARY OF THE INVENTION

The present invention is directed to integrated circuits. More particularly, the invention provides systems and methods for dimming control. Merely by way of example, the invention has been applied for dimming control using a light dimmer with capacitive loads. But it would be recognized that the invention has a much broader range of applicability.

According to one embodiment, a system for dimming control includes a system controller including a first controller terminal and a second controller terminal, a transistor including a first transistor terminal, a second transistor terminal and a third transistor terminal, and a resistor including a first resistor terminal and a second resistor terminal. The system controller is configured to generate a first signal at the first controller terminal based on at least information associated with an input signal and to generate a second signal at the second controller terminal based on at least information associated with the first signal. Moreover, the first transistor terminal is coupled, directly or indirectly, to the second controller terminal. The second transistor terminal is biased at a first voltage. Additionally, the first resistor terminal is coupled to the second transistor terminal, and the second resistor terminal is coupled to the third transistor terminal. Furthermore, the transistor is configured to receive the second signal at the first transistor terminal and to change between a first condition and a second condition in response to the second signal. The first signal is at a first logic level during a first period of time and changes between the first logic level and a second logic level during a second period of time, the second period of time including a third period of time and a fourth period of time. Additionally, the second signal keeps at the second logic level during the first period of time and the third period of time, and the second signal changes from the second logic level to the first logic level after the third period of time and remains at the first logic level during the fourth period of time.

According to another embodiment, a system for dimming control includes a system controller including a first controller terminal, a second controller terminal, and a third controller terminal, a first transistor including a first transistor terminal, a second transistor terminal and a third transistor terminal, and a first resistor including a first resistor terminal and a second resistor terminal. The system controller is configured to generate a first signal at the first controller terminal based on at least information associated with an input signal and to generate a second signal at the second controller terminal based on at least information associated with the first signal. Moreover, the first transistor terminal is coupled, directly or indirectly, to the second controller terminal. The second transistor terminal is coupled, directly or indirectly, to the third controller terminal, the third controller terminal being biased at a first voltage. Additionally, the first resistor terminal is coupled to the second transistor terminal, and the second resistor terminal is coupled to the third transistor terminal. Furthermore, the first transistor is configured to receive the second signal at the first transistor terminal and to change between a first condition and a second condition in response to the second signal.

According to yet another embodiment, a method for dimming control includes receiving an input signal, processing information associated with the input signal, and generating a first signal based on at least information associated with the input signal. Additionally, the method includes processing information associated with the first signal, generating a second signal based on at least information associated with the first signal, receiving the second signal at a transistor, and changing the transistor between a first condition and a second condition based on at least information associated with the second signal. The first signal is at a first logic level during a first period of time and changes between the first logic level and a second logic level during a second period of time, the second period of time including a third period of time and a fourth period of time. The second signal keeps at the second logic level during the first period of time and the third period of time. Additionally, the second signal changes from the second logic level to the first logic level after the third period of time and remains at the first logic level during the fourth period of time.

According to yet another embodiment, a system controller for dimming control includes a first controller terminal, a second controller terminal, and a third controller terminal. The system controller is configured to receive an input signal at the first controller terminal, generate a first signal at the second controller terminal based on at least information associated with the input signal, and process information associated with the first signal. Additionally, the system controller is configured to generate a second signal based on at least information associated with the first signal, and output the second signal at the third controller terminal. The first signal is at a first logic level during a first period of time and changes between the first logic level and a second logic level during a second period of time, the second period of time including a third period of time and a fourth period of time. The second signal keeps at the second logic level during the first period of time and the third period of time. Additionally, the second signal changes from the second logic level to the first logic level after the third period of time and remains at the first logic level during the fourth period of time.

According to yet another embodiment, a method for dimming control includes receiving an input signal, and generating a first signal based on at least information associated with the input signal, the first signal being at a first logic level during a first period of time and changing between the first logic level and a second logic level during a second period of time, the second period of time including a third period of time and a fourth period of time. Additionally, the method includes processing information associated with the first signal, generating a second signal based on at least information associated with the first signal, and outputting the second signal, the second signal keeping at the second logic level during the first period of time and the third period of time, the second signal changing from the second logic level to the first logic level after the third period of time and remaining at the first logic level during the fourth period of time.

Many benefits are achieved by way of the present invention over conventional techniques. For example, some embodiments of the present invention provide an input signal of which each period includes a first part and a second part. As an example, during the first part, the input signal changes with time in magnitude, and during the second part, the input signal does not change with time in magnitude. In another example, the input signal is generated by a TRIAC. Certain embodiments of the present invention provide a system controller configured to generate a first signal at a first logic level during a first period of time and to change the first signal between the first logic level and a second logic level during a second period of time. Some embodiments of the present invention provide a system controller including a sensing component configured to receive a first signal and to generate a logic signal based on at least information associated with the first signal, and a control and driver component configured to detect the logic signal and to generate a second signal based on at least information associated with the logic signal. Certain embodiments of the present invention provide one or more transistors to be used for dimming control. For example, a transistor is configured to be turned on under a first condition in response to a signal, and to be turned off under a second condition in response to the signal. In yet another example, two first transistors are configured to be turned on under a first condition in response to a signal in order to turn off a second transistor. In another example, the two first transistors are configured to be turned off under a second condition in response to the signal in order to turn on the second transistor.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

The present invention is directed to integrated circuits. More particularly, the invention provides systems and methods for dimming control. Merely by way of example, the invention has been applied for dimming control using a light dimmer with capacitive loads. But it would be recognized that the invention has a much broader range of applicability.

Figure 1:
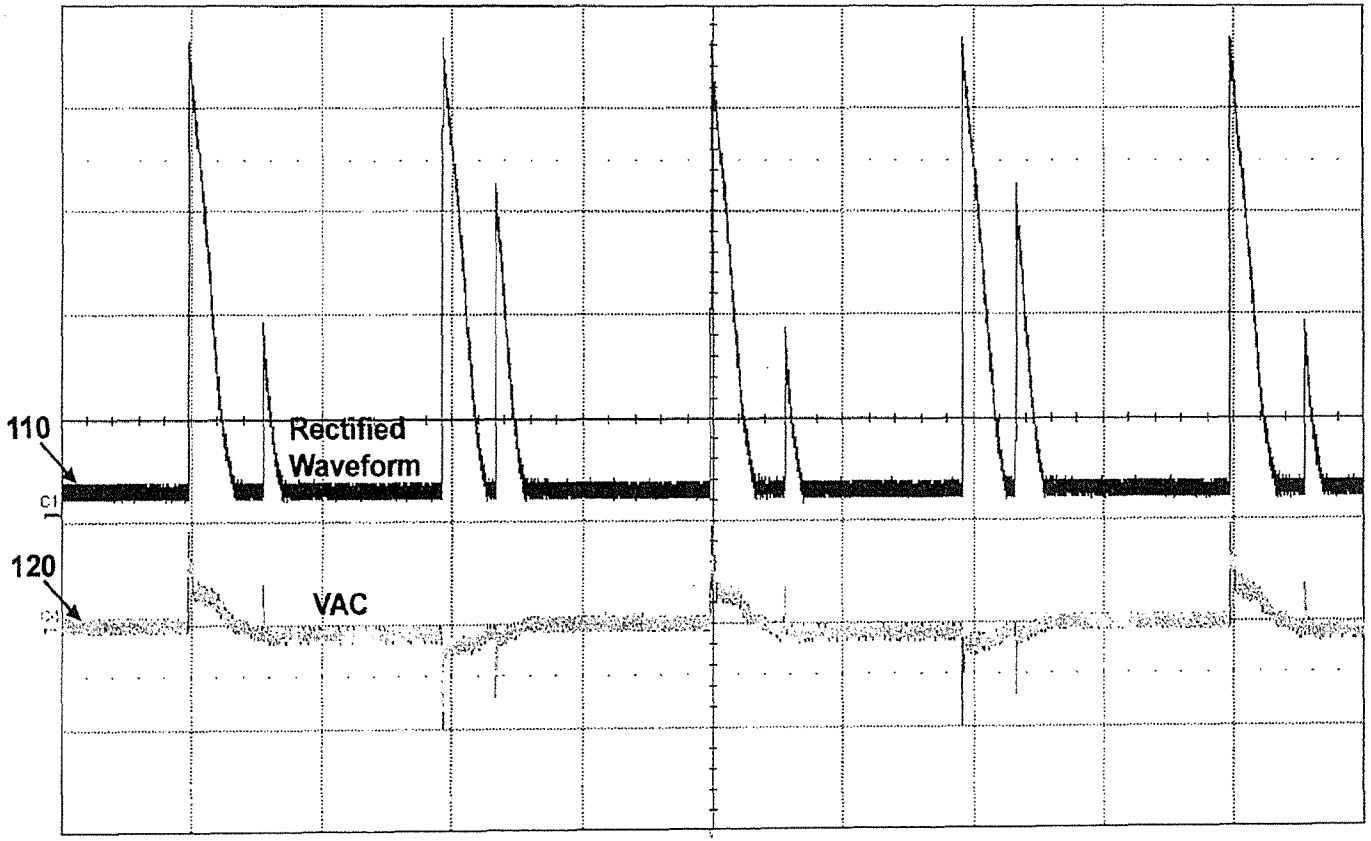
Fig. 1 (Prior Art)
FIG. 1 shows simplified signal waveforms of a conventional light dimmer that is connected to capacitive loads.
Figure 2:
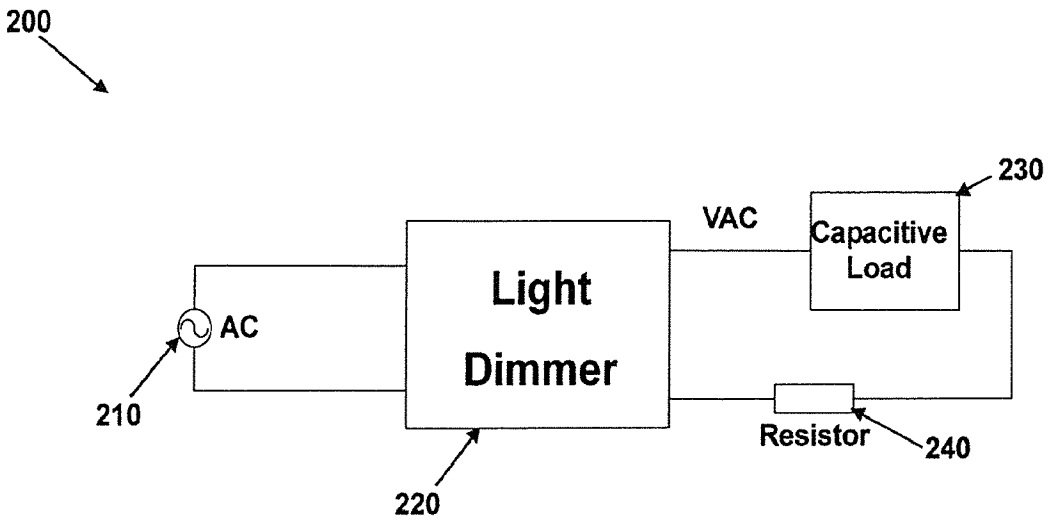
Fig. 2 (Prior Art)
FIG. 2 is a simplified diagram of a conventional light dimmer circuit.
Figure 3:
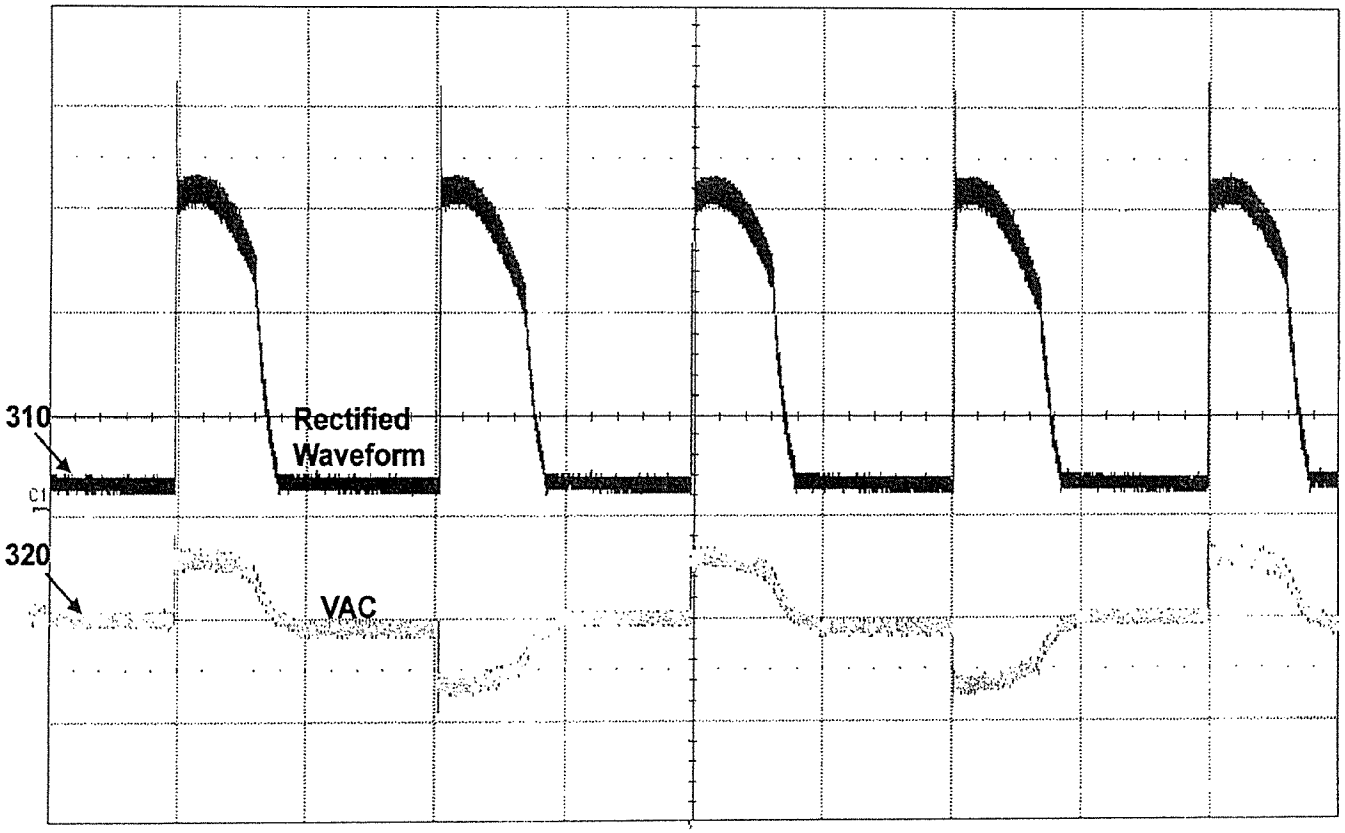
Fig. 3 (Prior Art)
FIG. 3 shows simplified conventional signal waveforms of a light dimmer circuit.
Figure 4:
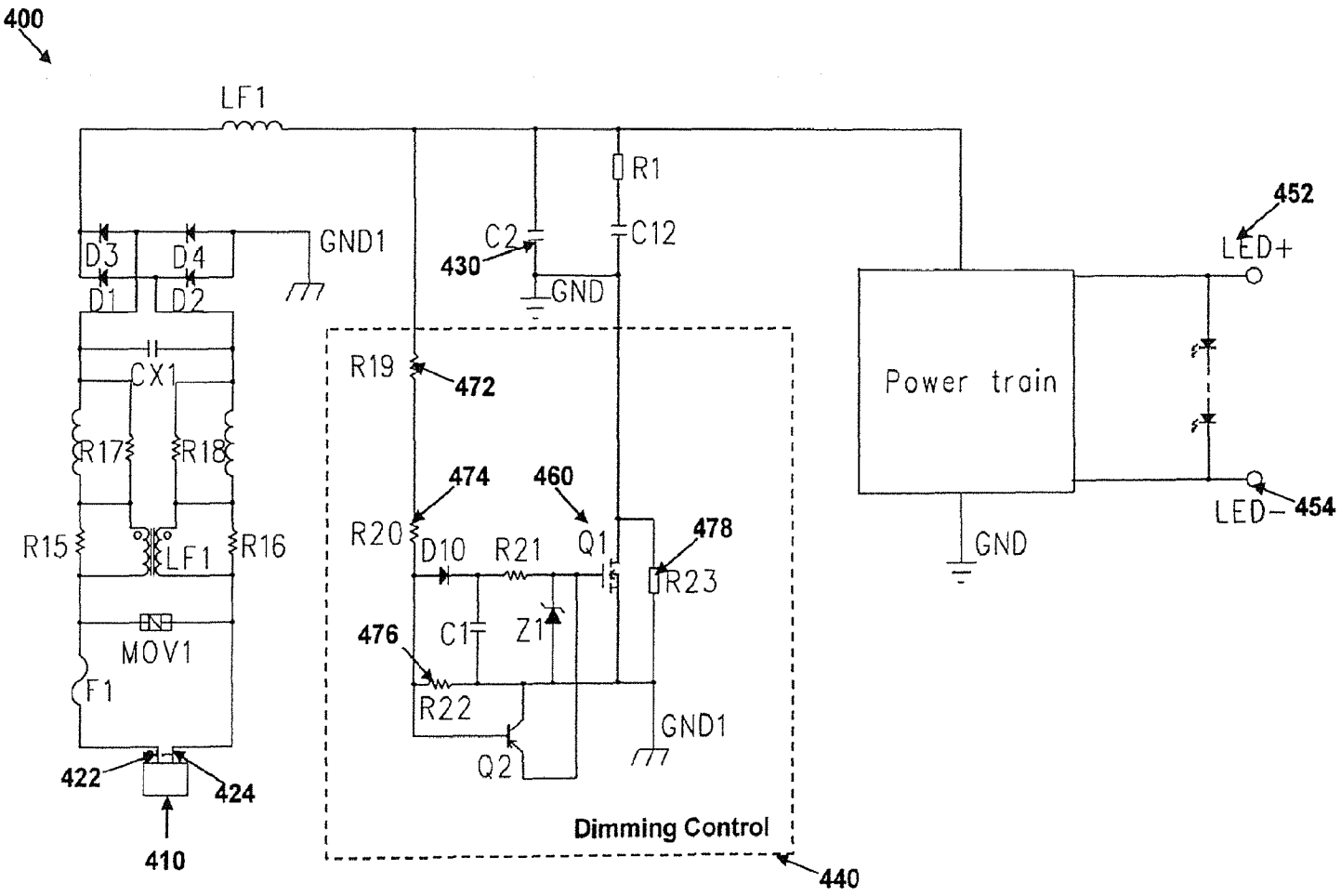
Fig. 4 (Prior Art)
FIG. 4 is a simplified conventional diagram showing a system for dimming control.
Figure 5:
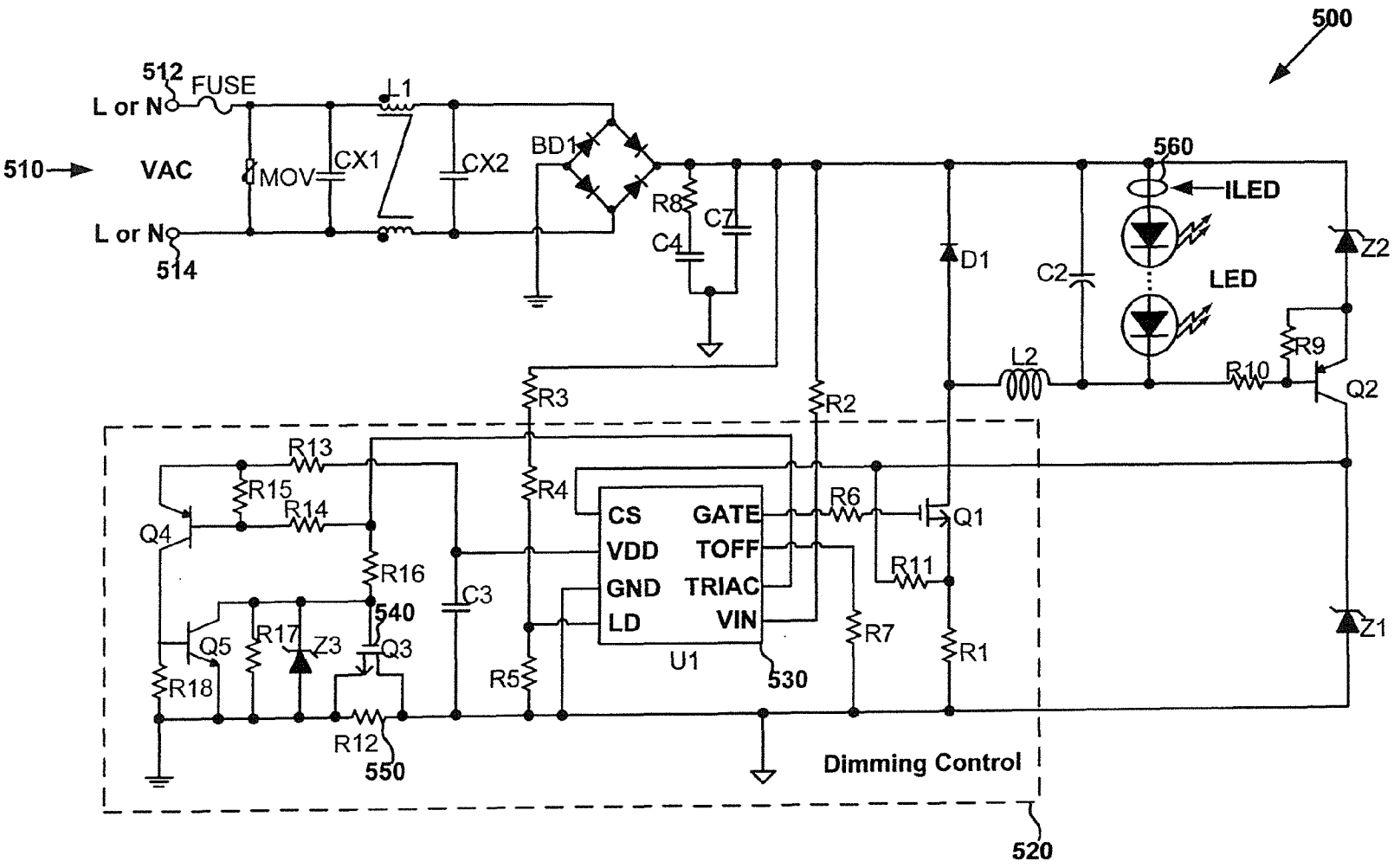
FIG. 5 is a simplified diagram showing a system for dimming control according to an embodiment of the present invention.

FIG. 5 is a simplified diagram showing a system for dimming control according to an embodiment of the present invention. This diagram is merely an example, which should not unduly limit the scope of the claims. One of ordinary skill in the art would recognize many variations, alternatives, and modifications. The system 500 includes at least input terminals 512 and 514, and a dimming control circuit 520. For example, the dimming control circuit 520 includes at least a system controller 530, a transistor 540, and a resistor 550.

According to one embodiment, a light dimmer (e.g., a TRIAC not shown in FIG. 5) sends an input signal 510 (e.g., the signal VAC) to the input terminals 512 and 514. In response, the system controller 530 generates one or more control signals to affect operating status of the transistor 540 and the resistor 550. As an example, the transistor 540 and the resistor 550 are connected in parallel as shown in FIG. 5. According to another embodiment, the control signals turn the transistor 540 off, allowing the resistor 550 to dampen initial current surge to one or more capacitive loads. After the light dimmer conducts for a predetermined period of time, the control signals then, for example, turn on the transistor 540, thus shorting the resistor 550 in order to improve the system efficiency. In another example, the system 500 operates with a broad range of inputs and outputs, such as an input range of AC 90V~264V, and an output range of 20V~50V/350 mA.

Figure 6:
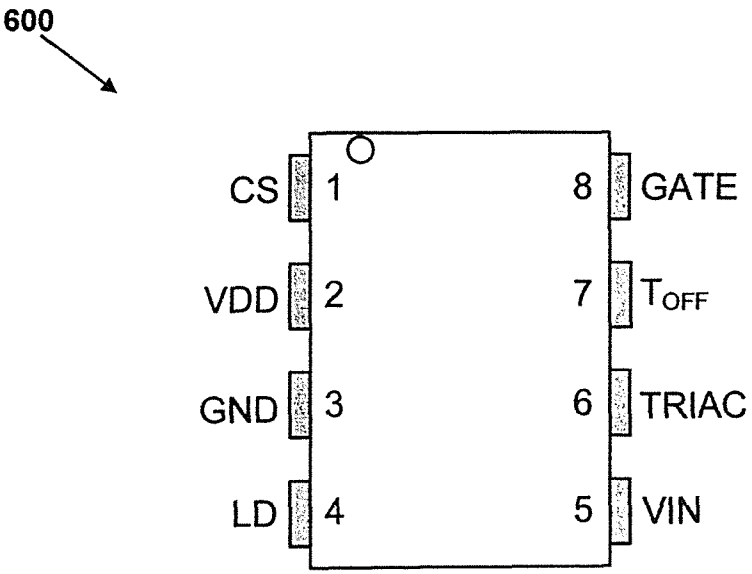
FIG. 6 is a simplified diagram of a system controller according to an embodiment of the present invention.

FIG. 6 is a simplified diagram of a system controller according to an embodiment of the present invention. This diagram is merely an example, which should not unduly limit the scope of the claims. One of ordinary skill in the art would recognize many variations, alternatives, and modifications. In one embodiment, the system controller 600 is the same as the system controller 530. In another embodiment, different pins of the system controller 600 are used for different purposes. Table 1 shows, as an example, description of eight pins in the system controller 600.

TABLE 1

| Pin No. | Pin Name | Description |
|---|---|---|
| 1 | CS | MOSFET current detection input signal |
| 2 | VDD | Internal circuit supply voltage |
| 3 | GND | On-chip ground |

TABLE 1-continued

| Pin No. | Pin Name | Description |
|---|---|---|
| 4 | LD | Linear dimming input signal |
| 5 | VIN | Input signal (e.g., 20 V~500 V) |
| 6 | TRIAC | Dimming control output (e.g., for TRIAC) |
| 7 | TOFF | GATE off time |
| 8 | GATE | GATE output (e.g., for BUCK circuit) |

Figure 7:
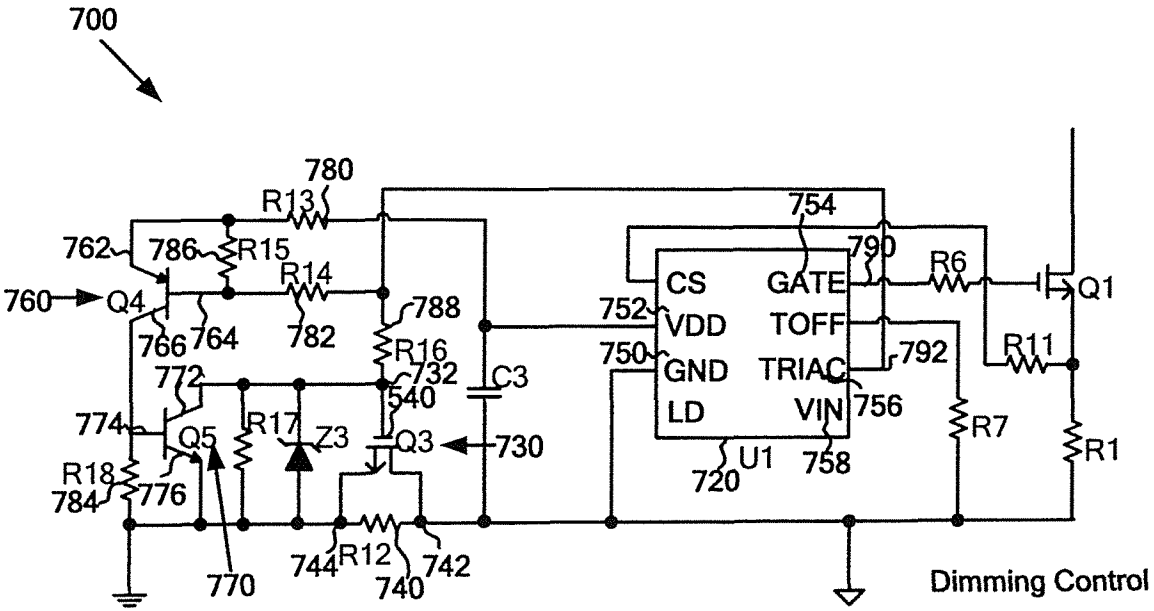
FIG. 7 is a simplified diagram of a dimming control circuit according to an embodiment of the present invention.

FIG. 7 is a simplified diagram of a dimming control circuit according to an embodiment of the present invention. This diagram is merely an example, which should not unduly limit the scope of the claims. One of ordinary skill in the art would recognize many variations, alternatives, and modifications.

According to one embodiment, the dimming control circuit 700 includes a system controller 720, a transistor 730, and a resistor 740. For example, the dimming control circuit 700 is used as the dimming control circuit 520. In another example, the system controller 720, the transistor 730, and the resistor 740 are the same as the system controller 530, the transistor 540, and the resistor 550, respectively. In yet another example, the system controller 720 is the same as the system controller 600. In yet another example, the transistor 730 is a field effect transistor (FET), such as an N-channel FET. In yet another example, the system controller 720 includes a terminal 750 (e.g., a GND terminal), a terminal 752 (e.g., a VDD terminal), a terminal 754 (e.g., a GATE terminal), a terminal 756 (e.g., a TRIAC terminal), and a terminal 758 (e.g., a VIN terminal).

According to another embodiment, the resistor 740 is coupled in parallel with the transistor 730. A terminal 742 of the resistor 740 is biased to an on-chip ground of the system controller 720. For example, the terminal 742 is connected to the terminal 750 of the system controller 720 (e.g., the GND terminal). In another example, the voltage of the on-chip ground of the system controller 720 may change with time. In another example, another terminal 744 of the resistor 740 is biased to the ground (e.g., an off-chip ground and/or an external ground).

Although the above has been shown using a selected group of components for the circuit 700, there can be many alternatives, modifications, and variations. For example, some of the components may be expanded and/or combined. Other components may be inserted to those noted above. For example, the dimming control circuit 700 also includes two additional transistors 760 and 770. These transistors may be bipolar transistors, such as N-P-N and/or P-N-P bipolar transistors.

As an example, a terminal 762 of the transistor 760 is coupled, directly or indirectly through a resistor 780, to the terminal 752 of the system controller 720 (e.g., the VDD terminal). For example, the internal circuit supply voltage of the terminal 752 may change with time. In another example, a terminal 764 of the transistor 760 is coupled directly or indirectly through a resistor 782, to the terminal 756 of the system controller 720 (e.g., the TRIAC terminal). In yet another example, a terminal 766 of the transistor 760 is coupled directly to a terminal 774 of the transistor 770. In yet another example, a terminal 772 of the transistor 770 is coupled directly to a terminal 732 of the transistor 730. In yet another example, a terminal 776 is biased to the ground. In yet another example, the terminal 772 is coupled indirectly through a resistor 784, to the terminal 776. In yet another example, the terminal 764 is coupled indirectly through a resistor 786, to the terminal 762. In yet another example, the terminal 764 is coupled indirectly through the resistor 782 and a resistor 788, to the terminal 732.

According to one embodiment, before a light dimmer (e.g., a TRIAC not shown in FIG. 7) starts conduction, the system controller 720 generates a gate signal 790 at the terminal 754 (e.g., the GATE terminal). The gate signal 790 is at a logic high level or at a logic low level. Additionally, the system controller 720 generates a dimming control signal 792 at the terminal 756 (e.g., the TRIAC terminal). The dimming control signal 792 is at the logic high level or at the logic low level.

In one embodiment, in response to an input signal at the terminal 758 (e.g., the VIN terminal), the system controller 720 changes the gate signal 790 from being at the logic high level to being a pulse signal that changes between the logic high level and the logic low level. In the meantime, the dimming control signal 792 remains at the logic low level in order to turn on the transistors 760 and 770. Hence, according to one embodiment, the transistor 730 remains off and the resistor 740 is used to dampen any initial surge current to one or more capacitive loads. After a predetermined period of time, the system controller 720 changes the dimming control signal from the logic low level to the logic high level, causing the transistors 760 and 770 to be turned off. In response, the transistor 730 is turned on and the resistor 740 is shorted to improve system efficiency according to one embodiment. For example, the predetermined period of time is equal to one or more periods (e.g., 4, 6, 8, or 10 periods) of the pulse signal for the gate signal 790.

Figure 8:
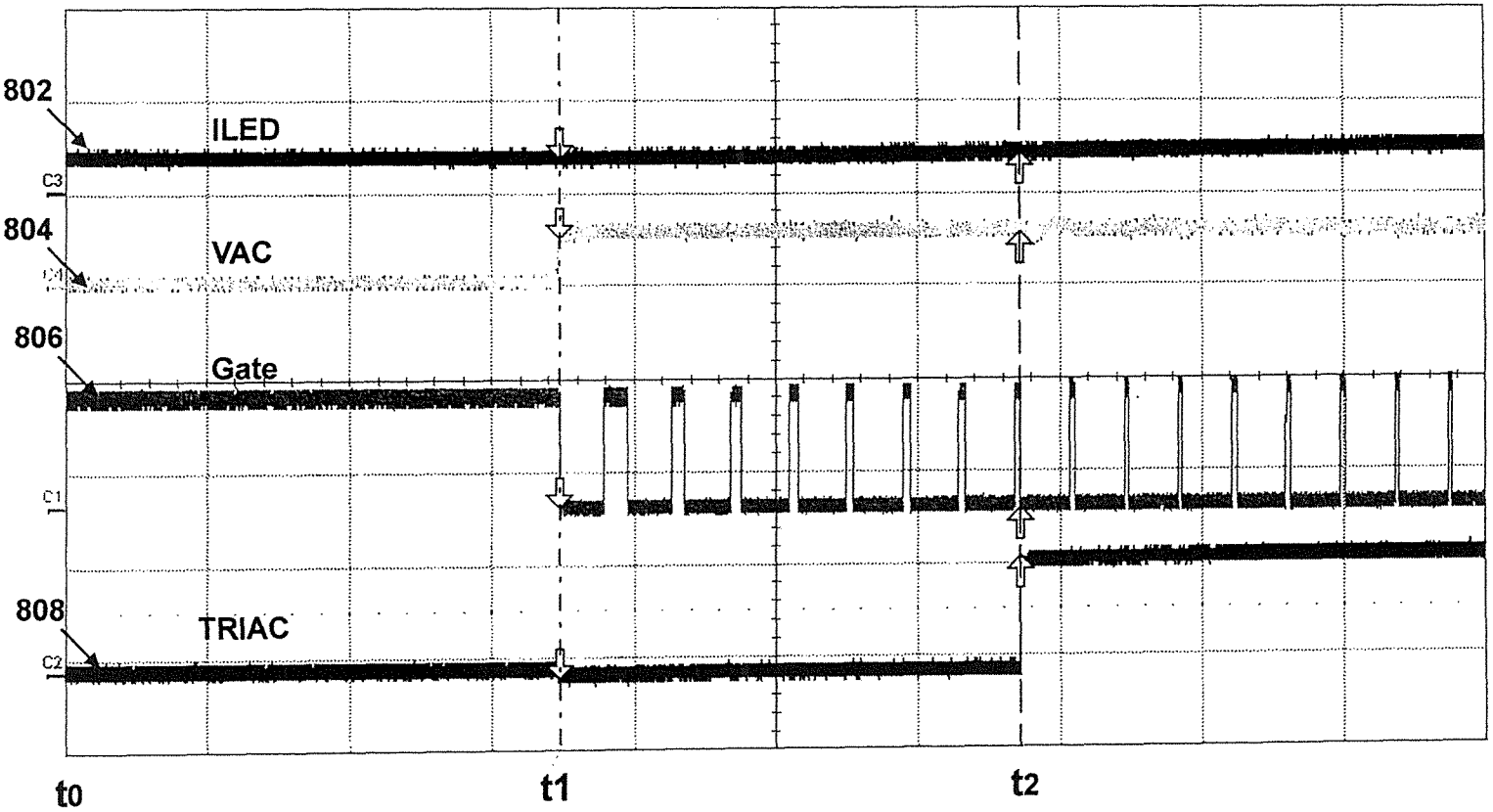
FIG. 8 shows simplified timing diagrams for a dimming control circuit as part of a system for dimming control according to an embodiment of the present invention.

FIG. 8 shows simplified timing diagrams for the dimming control circuit 700 as part of the system 500 according to an embodiment of the present invention. These diagrams are merely examples, which should not unduly limit the scope of the claims. One of ordinary skill in the art would recognize many variations, alternatives, and modifications.

As shown in FIG. 8, curves 802, 804, 806 and 808 represent the timing diagrams for an output current 560 (as shown in FIG. 5), the input signal 510, the gate signal 790, and the dimming control signal 792, respectively.

According to one embodiment, between $t_0$ and $t_1$, the input signal 510 (corresponding to the curve 804) is constant in magnitude. During this period of time, the gate signal 790 (corresponding to the curve 806) keeps at the logic high level, and the dimming control signal 792 (corresponding to the curve 808) keeps at the logic low level.

According to anther embodiment, at $t_1$, the input signal 510 (corresponding to the curve 804) starts changing with time in magnitude. In response, the gate signal 790 (corresponding to the curve 806) becomes a pulse signal. During the period of time between $t_1$ and $t_2$, the dimming control signal 792 (corresponding to the curve 808) remains at the logic low level. For example, during this period of time, the transistor 730 is turned off and the resistor 740 is used to dampen any initial surge current. In another example, the period of time between $t_1$ and $t_2$ equals one or more periods (e.g., 4, 6, 8, or 10 periods) of the pulse signal for the gate signal 790. After $t_2$, the dimming control signal 792 (corresponding to the curve 808) rises from the logic low level to the logic high level, and then remains at the logic high level for a period of time according to one embodiment. In response, the transistor 730 is turned on and thus the resistor 740 is shorted.

Figure 9:
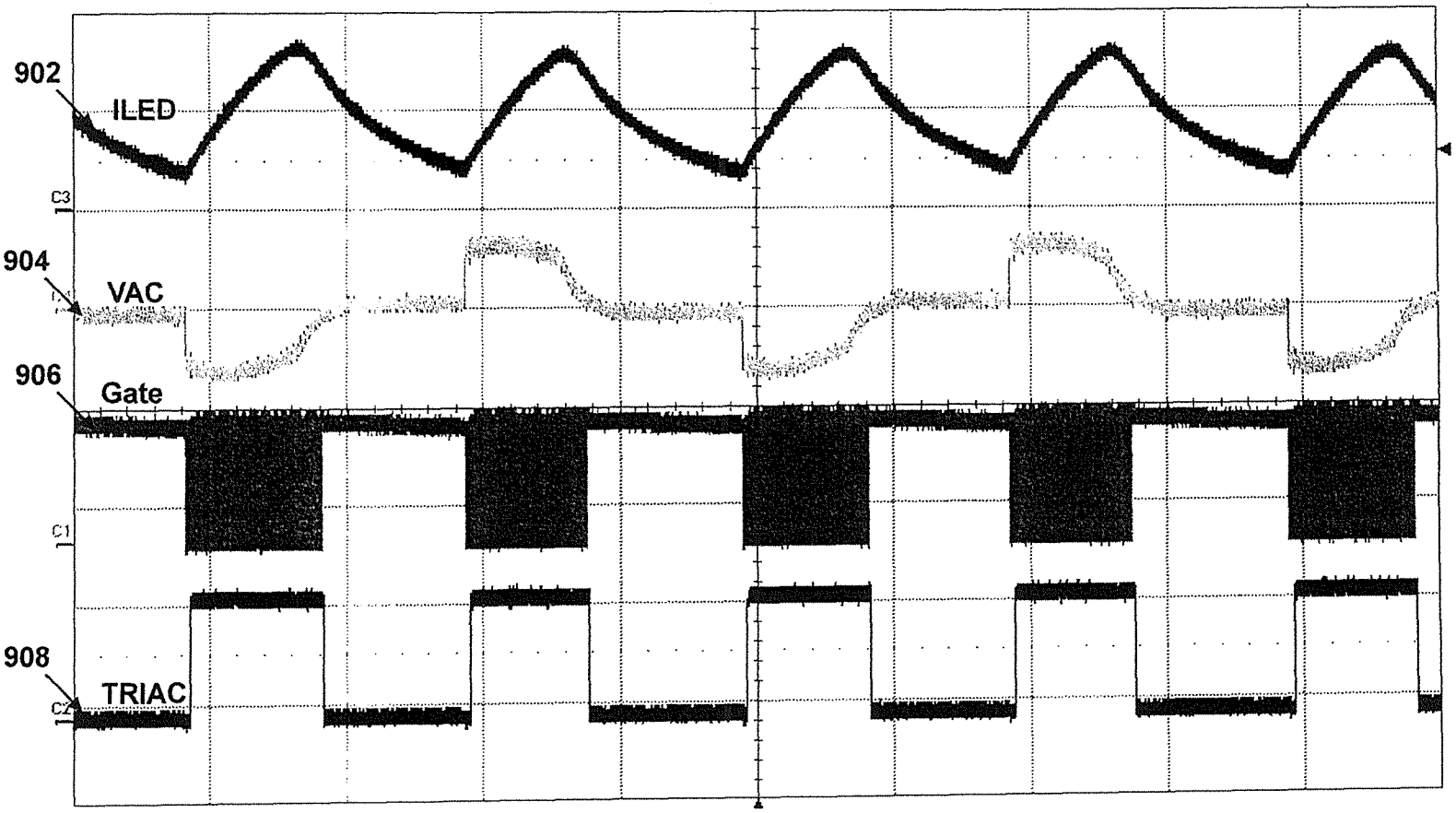
FIG. 9 shows simplified timing diagrams for a dimming control circuit as part of a system for dimming control according to an embodiment of the present invention.

FIG. 9 shows simplified timing diagrams for the dimming control circuit 700 as part of the system 500 according to an embodiment of the present invention. These diagrams are merely examples, which should not unduly limit the scope of the claims. One of ordinary skill in the art would recognize many variations, alternatives, and modifications. For example, FIG. 8 is an enlarged representation of a portion of FIG. 9. In another example, curves 802, 804, 806 and 808 represent a part of the curves 902, 904, 906 and 908, respectively.

As shown in FIG. 9, the curves 902, 904, 906 and 908 represent the timing diagrams for the output current 560, the input signal 510, the gate signal 790, and the dimming control signal 792, respectively.

According to one embodiment, when the input signal 510 (corresponding to the curve 904) is constant in magnitude, the output current 560 (corresponding to the curve 902) decreases with time. According to another embodiment, when the input signal 510 (corresponding to the curve 904) changes with time in magnitude, the output current 560 (corresponding to the curve 902) increases to a peak value and then decreases.

As shown in FIG. 9, the gate signal 790 (corresponding to the curve 906) changes between being at the logic high level and being a pulse signal over time. In response, the dimming control signal 792 (corresponding to the curve 908) changes with a delay. Specifically, as shown in FIG. 8, the dimming control signal 792 (corresponding to the curves 908 and 808) changes from the logic low level to the logic high level after a first delay (e.g., the first delay equal to a time period from $t_1$ to $t_2$) after the gate signal 790 (corresponding to the curves 906 and 806) has become the pulse signal according to one embodiment. According to another embodiment, after the gate signal 790 (corresponding to the curve 906) changes from being a pulse signal back to being at the logic high level, the dimming control signal 792 (corresponding to the curve 908) changes from the logic high level to the logic low level with a second delay. The first delay and the second delay are the same or different in magnitude.

Figure 10:
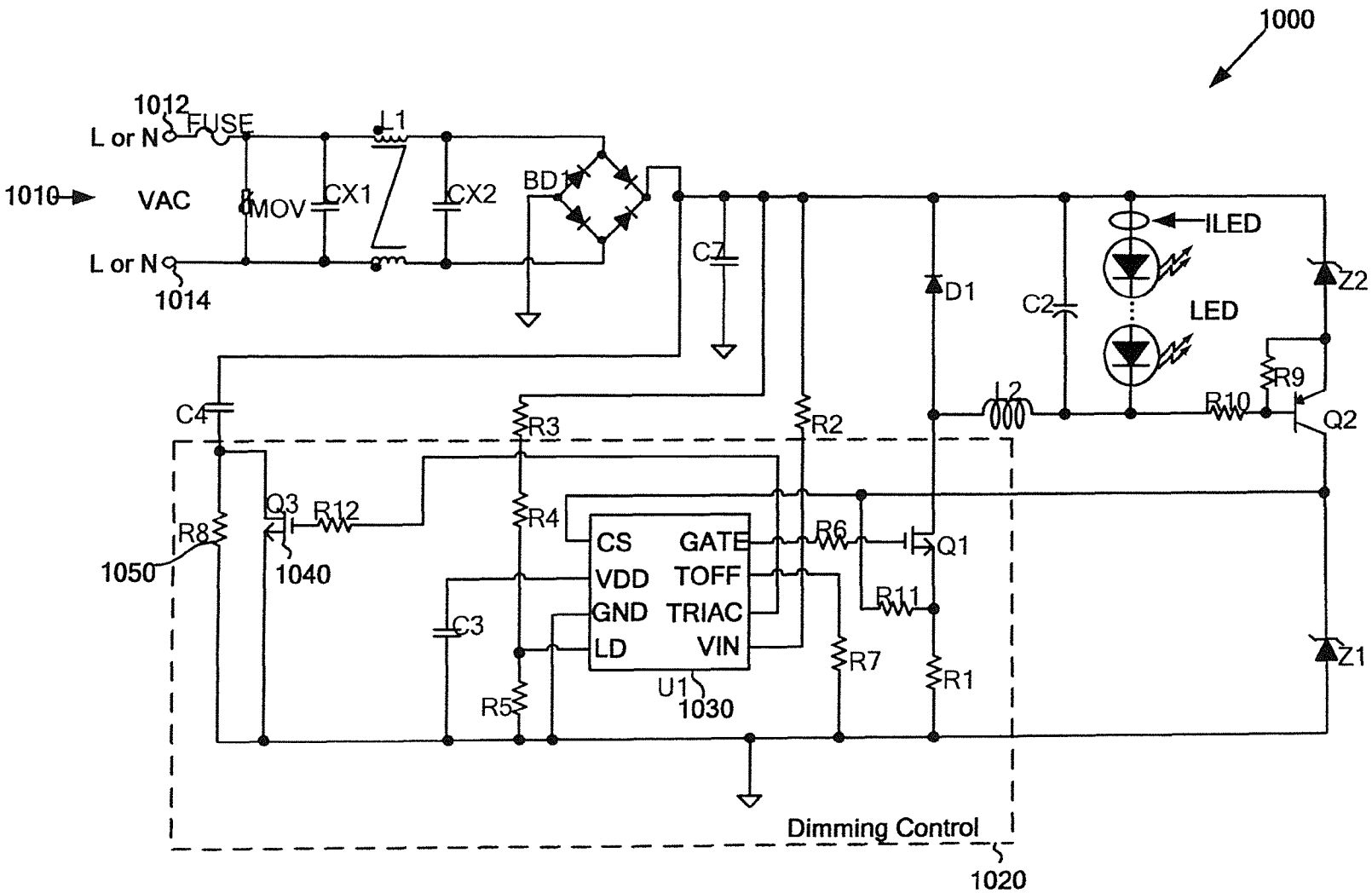
FIG. 10 is a simplified diagram showing a system for dimming control according to another embodiment of the present invention.

FIG. 10 is a simplified diagram showing a system for dimming control according to another embodiment of the present invention. This diagram is merely an example, which should not unduly limit the scope of the claims. One of ordinary skill in the art would recognize many variations, alternatives, and modifications. The system 1000 includes at least input terminals 1012 and 1014, and a dimming control circuit 1020. For example, the dimming control circuit 1020 includes a system controller 1030, a transistor 1040 and a resistor 1050. In another example, the system controller 530 is the same as the system controller 1030. In yet another example, the operations of the system 1000 is described by FIG. 8 and/or FIG. 9.

According to one embodiment, a light dimmer (e.g., a TRIAC not shown in FIG. 10) sends an input signal 1010 (e.g., the signal VAC) to the input terminals 1012 and 1014. In response, the system controller 1030 generates one or more control signals to affect operating status of the transistors 1040 and the resistor 1050. As an example, the transistor 1040 and the resistor 1050 are connected in parallel as shown in FIG. 10. The control signals turns off the transistor 1040, allowing the resistor 1050 to dampen initial current surge to one or more capacitive loads. After the light dimmer conducts for a predetermined period of time, the control signals then, for example, turn on the transistor 1040, thus shorting the resistor 1050 in order to improve the system efficiency.

Figure 11:
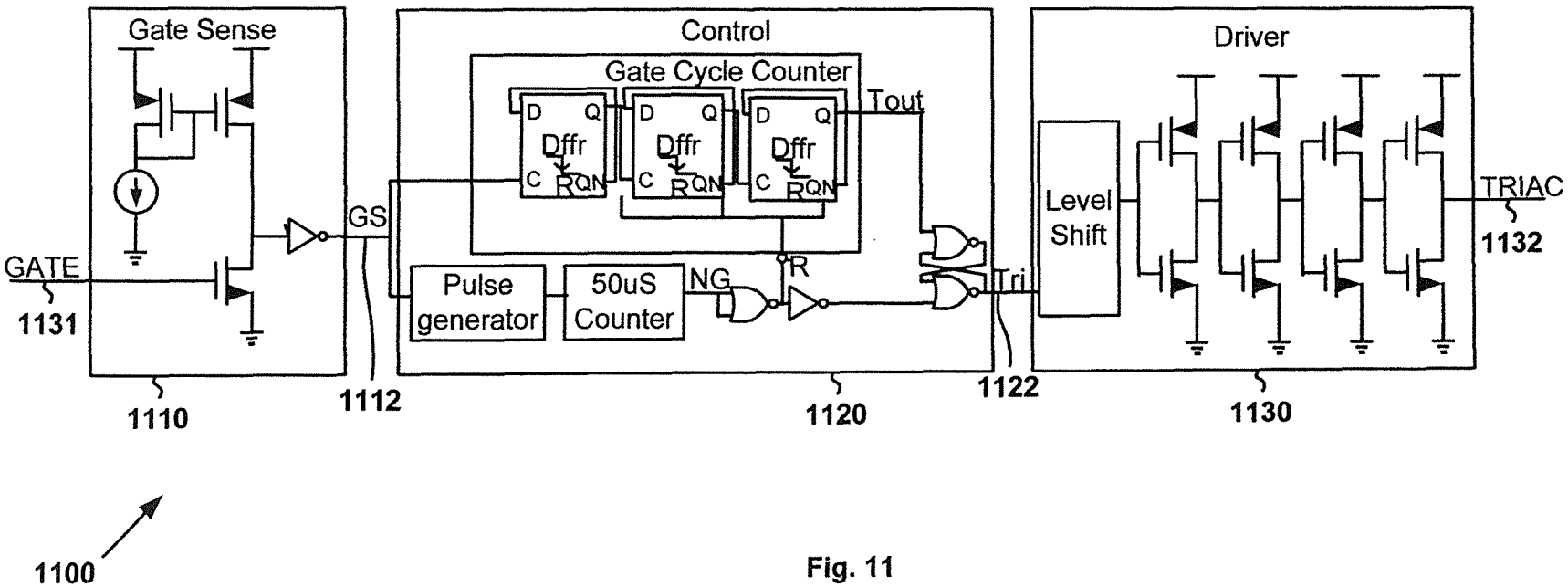
FIG. 11 is a simplified diagram showing certain components of a system controller according to an embodiment of the present invention.

FIG. 11 is a simplified diagram showing certain components of a system controller according to an embodiment of the present invention. This diagram is merely an example, which should not unduly limit the scope of the claims. One of ordinary skill in the art would recognize many variations, alternatives, and modifications. The system controller 1100 includes at least a gate sense module 1110, a control module 1120, and a driver module 1130. For example, the system controller 1100 is the same as the system controller 530, the system controller 600, the system controller 720, and/or the system controller 1030.

In one embodiment, the gate sense module 1110 receives a gate signal 1131 (e.g., the gate signal 790), and transforms the gate signal 1131 to an internal logic signal 1112 (e.g., the GS signal). For example, the gate signal 1131 is received and used by one or more components that are internal to the system controller 1100. In another embodiment, the control module 1120 detects the logic signal 1112 and in response generates a signal 1122 (e.g., the Tri signal). In yet another embodiment, the driver module 1130 receives the signal 1122 and outputs a dimming control signal 1132 (e.g., the dimming control signal 792).

According to another embodiment, a system for dimming control includes a system controller including a first controller terminal and a second controller terminal, a transistor including a first transistor terminal, a second transistor terminal and a third transistor terminal, and a resistor including a first resistor terminal and a second resistor terminal. The system controller is configured to generate a first signal at the first controller terminal based on at least information associated with an input signal and to generate a second signal at the second controller terminal based on at least information associated with the first signal. Moreover, the first transistor terminal is coupled, directly or indirectly, to the second controller terminal. The second transistor terminal is biased at a first voltage. Additionally, the first resistor terminal is coupled to the second transistor terminal, and the second resistor terminal is coupled to the third transistor terminal. Furthermore, the transistor is configured to receive the second signal at the first transistor terminal and to change between a first condition and a second condition in response to the second signal. The first signal is at a first logic level during a first period of time and changes between the first logic level and a second logic level during a second period of time, the second period of time including a third period of time and a fourth period of time. Additionally, the second signal keeps at the second logic level during the first period of time and the third period of time, and the second signal changes from the second logic level to the first logic level after the third period of time and remains at the first logic level during the fourth period of time. For example, the system is implemented according to at least FIG. 5, FIG. 7, and/or FIG. 10.

According to another embodiment, a system for dimming control includes a system controller including a first controller terminal, a second controller terminal, and a third controller terminal, a first transistor including a first transistor terminal, a second transistor terminal and a third transistor terminal, and a first resistor including a first resistor terminal and a second resistor terminal. The system controller is configured to generate a first signal at the first controller terminal based on at least information associated with an input signal and to generate a second signal at the second controller terminal based on at least information associated with the first signal. Moreover, the first transistor terminal is coupled, directly or indirectly, to the second controller terminal. The second transistor terminal is coupled, directly or indirectly, to the third controller terminal, the third controller terminal being biased at a first voltage. Additionally, the first resistor terminal is coupled to the second transistor terminal, and the second resistor terminal is coupled to the third transistor terminal. Furthermore, the first transistor is configured to receive the second signal at the first transistor terminal and to change between a first condition and a second condition in response to the second signal. For example, the system is implemented according to at least FIG. 5, FIG. 7, and/or FIG. 10.

According to yet another embodiment, a method for dimming control includes receiving an input signal, processing information associated with the input signal, and generating a first signal based on at least information associated with the input signal. Additionally, the method includes processing information associated with the first signal, generating a second signal based on at least information associated with the first signal, receiving the second signal at a transistor, and changing the transistor between a first condition and a second condition based on at least information associated with the second signal. The first signal is at a first logic level during a first period of time and changes between the first logic level and a second logic level during a second period of time, the second period of time including a third period of time and a fourth period of time. The second signal keeps at the second logic level during the first period of time and the third period of time. Additionally, the second signal changes from the second logic level to the first logic level after the third period of time and remains at the first logic level during the fourth period of time. For example, the method is performed according to at least FIG. 5, FIG. 7, FIG. 8, FIG. 9, and/or FIG. 10.

According to yet another embodiment, A system controller for dimming control includes a first controller terminal, a second controller terminal, and a third controller terminal. The system controller is configured to receive an input signal at the first controller terminal, generate a first signal at the second controller terminal based on at least information associated with the input signal, and process information associated with the first signal. Additionally, the system controller is configured to generate a second signal based on at least information associated with the first signal, and output the second signal at the third controller terminal. The first signal is at a first logic level during a first period of time and changes between the first logic level and a second logic level during a second period of time, the second period of time including a third period of time and a fourth period of time. The second signal keeps at the second logic level during the first period of time and the third period of time. Additionally, the second signal changes from the second logic level to the first logic level after the third period of time and remains at the first logic level during the fourth period of time. For example, the system controller is implemented in at least FIG. 5, FIG. 6, FIG. 7, FIG. 10, and/or FIG. 11.

According to yet another embodiment, a method for dimming control includes receiving an input signal, and generating a first signal based on at least information associated with the input signal, the first signal being at a first logic level during a first period of time and changing between the first logic level and a second logic level during a second period of time, the second period of time including a third period of time and a fourth period of time. Additionally, the method includes processing information associated with the first signal, generating a second signal based on at least information associated with the first signal, and outputting the second signal, the second signal keeping at the second logic level during the first period of time and the third period of time, the second signal changing from the second logic level to the first logic level after the third period of time and remaining at the first logic level during the fourth period of time. For example, the method is performed in at least FIG. 5, FIG. 6, FIG. 7, FIG. 8, FIG. 9, FIG. 10, and/or FIG. 11.

Many benefits are achieved by way of the present invention over conventional techniques. For example, some embodiments of the present invention provide an input signal of which each period includes a first part and a second part. As an example, during the first part, the input signal changes with time in magnitude, and during the second part, the input signal does not change with time in magnitude. In another example, the input signal is generated by a TRIAC. Certain embodiments of the present invention provide a system controller configured to generate a first signal at a first logic level during a first period of time and to change the first signal between the first logic level and a second logic level during a second period of time. Some embodiments of the present invention provide a system controller including a sensing component configured to receive a first signal and to generate a logic signal based on at least information associated with the first signal, and a control and driver component configured to detect the logic signal and to generate a second signal based on at least information associated with the logic signal. Certain embodiments of the present invention provide one or more transistors to be used for dimming control. For example, a transistor is configured to be turned on under a first condition in response to a signal, and to be turned off under a second condition in response to the signal. In another example, two first transistors are configured to be turned on under a first condition in response to a signal in order to turn off a second transistor. In yet another example, the two first transistors are configured to be turned off under a second condition in response to the signal in order to turn on the second transistor.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for dimming control, the system comprising:

a system controller including a first controller terminal and a second controller terminal;

a transistor including a first transistor terminal, a second transistor terminal and a third transistor terminal; and a resistor including a first resistor terminal and a second resistor terminal;

wherein:

the system controller is configured to generate a first signal at the first controller terminal based at least in part on an input signal and to generate a second signal at the second controller terminal based at least in part on the first signal;

the first resistor terminal is coupled to the second transistor terminal;

the second resistor terminal is coupled to the third transistor terminal; and the transistor is configured to receive the second signal at the first transistor terminal and to change between a first condition and a second condition in response to the second signal;

wherein:

the first signal is at a first logic level during a first period of time and changes between the first logic level and a second logic level during a second period of time, the second period of time including a third period of time and a fourth period of time;

the second signal keeps at the second logic level during the first period of time and the third period of time; and the second signal changes from the second logic level to the first logic level after the third period of time and remains at the first logic level during the fourth period of time.

2. The system of claim 1 wherein:

the second transistor terminal is biased at a first voltage; and the first voltage changes with time.

3. The system of claim 1 wherein the transistor is configured to be turned on under the first condition and to be turned off under the second condition.

4. The system of claim 1 wherein the first logic level is a logic high level, and the second logic level is a logic low level.

5. The system of claim 1 wherein the first period of time is adjacent to the second period of time.

6. The system of claim 5 wherein:

the first period of time is adjacent to the third period of time; and the third period of time is adjacent to the fourth period of time.

7. The system of claim 5 wherein:

the second period of time and the third period of time share a same starting time; and the second period of time and the fourth period of time share a same ending time.

8. The system of claim 1 wherein:

at an ending time of the second period of time, the first signal becomes constant in magnitude at the first logic level; and at a delayed time, the second signal becomes constant in magnitude at the second logic level, the delayed time being after the ending time.

9. The system of claim 1 wherein the first resistor terminal is coupled, directly, to the second transistor terminal.

10. The system of claim 1 wherein the second resistor terminal is coupled, directly, to the third transistor terminal.

11. A method for dimming control, the method comprising:

receiving an input signal;

generating a first signal based at least in part on the input signal;

generating a second signal based at least in part on the first signal;

receiving the second signal at a transistor; and changing the transistor between a first condition and a second condition based at least in part on the second signal;

wherein:

the first signal is at a first logic level during a first period of time and changes between the first logic level and a second logic level during a second period of time, the second period of time including a third period of time and a fourth period of time;

the second signal keeps at the second logic level during the first period of time and the third period of time; and the second signal changes from the second logic level to the first logic level after the third period of time and remains at the first logic level during the fourth period of time.

12. The method of claim 11 wherein the changing the transistor between a first condition and a second condition includes:

turning on the transistor under the first condition; and turning off the transistor under the second condition.

13. The method of claim 11 wherein the first logic level is a logic high level, and the second logic level is a logic low level.

14. The method of claim 11 wherein the first period of time is adjacent to the second period of time.

15. The method of claim 14 wherein:

the first period of time is adjacent to the third period of time; and the third period of time is adjacent to the fourth period of time.

16. The method of claim 15 wherein:

the second period of time and the third period of time share a same starting time; and the second period of time and the fourth period of time share a same ending time.

17. The method of claim 11 wherein:

at an ending time of the second period of time, the first signal becomes constant in magnitude at the first logic level; and at a delayed time, the second signal becomes constant in magnitude at the second logic level, the delayed time being after the ending time.

18. A system controller for dimming control, the system controller comprising:

a first controller terminal; and a second controller terminal;

wherein the system controller is configured to:

generate a first signal at the first controller terminal based at least in part on an input signal;

generate a second signal based at least in part on the first signal; and output the second signal at the second controller terminal to change a transistor between a first condition and a second condition;

wherein:

the first signal is at a first logic level during a first period of time and changes between the first logic level and a second logic level during a second period of time, the second period of time including a third period of time and a fourth period of time;

the second signal keeps at the second logic level during the first period of time and the third period of time; and the second signal changes from the second logic level to the first logic level after the third period of time and remains at the first logic level during the fourth period of time.

19. The system controller of claim 18 wherein the first period of time is adjacent to the second period of time.

20. The system controller of claim 19 wherein:

the first period of time is adjacent to the third period of time; and the third period of time is adjacent to the fourth period of time.

21. The system controller of claim 20 wherein:

the second period of time and the third period of time share a same starting time; and the second period of time and the fourth period of time share a same ending time.

22. The system controller of claim 18 wherein:

at an ending time of the second period of time, the first signal becomes constant in magnitude at the first logic level; and at a delayed time, the second signal becomes constant in magnitude at the second logic level, the delayed time being after the ending time.

23. A method for dimming control, the method comprising:

receiving an input signal;

generating a first signal based at least in part on the input signal, the first signal being at a first logic level during a first period of time and changing between the first logic level and a second logic level during a second period of time, the second period of time including a third period of time and a fourth period of time;

generating a second signal based at least in part on the first signal; and outputting the second signal, the second signal keeping at the second logic level during the first period of time and the third period of time, the second signal changing from the second logic level to the first logic level after the third period of time and remaining at the first logic level during the fourth period of time.

24. The method of claim 23 wherein the first period of time is adjacent to the second period of time.

25. The method of claim 24 wherein:

the first period of time is adjacent to the third period of time; and the third period of time is adjacent to the fourth period of time.

26. The method of claim 25 wherein:

the second period of time and the third period of time share a same starting time; and the second period of time and the fourth period of time share a same ending time.

27. The method of claim 23 wherein:

at an ending time of the second period of time, the first signal becomes constant in magnitude at the first logic level; and at a delayed time, the second signal becomes constant in magnitude at the second logic level, the delayed time being after the ending time.

28. A system for dimming control, the system comprising:

a system controller including a first controller terminal, a second controller terminal, and a third controller terminal;

a first transistor including a first transistor terminal, a second transistor terminal and a third transistor terminal; and a first resistor including a first resistor terminal and a second resistor terminal;

wherein:

the system controller is configured to generate a first signal at the first controller terminal based at least in part on an input signal and to generate a second signal at the second controller terminal based at least in part on the first signal;

the second transistor terminal is coupled to the third controller terminal;

the first resistor terminal is coupled to the second transistor terminal;

the second resistor terminal is coupled to the third transistor terminal; and the first transistor is configured to receive the second signal at the first transistor terminal and to change between a first condition and a second condition in response to the second signal.

29. The system of claim 28 wherein:

each period of the input signal includes a first part and a second part;

during the first part, the input signal changes with time in magnitude; and during the second part, the input signal does not change with time in magnitude.

30. The system of claim 29 wherein the input signal is generated by a Triode for Alternating Current (TRIAC).

31. The system of claim 28 wherein the first transistor is an N-channel field effect transistor.

32. The system of claim 31 wherein the first transistor terminal is a gate terminal.

33. The system of claim 31 wherein the first transistor is configured to be turned on under the first condition and to be turned off under the second condition.

34. The system of claim 28 wherein the system controller is further configured to generate the first signal at a first logic level during a first period of time and to change the first signal between the first logic level and a second logic level during a second period of time, the second period of time including a third period of time and a fourth period of time.

35. The system of claim 34 wherein the system controller is further configured to generate the second signal at the second logic level during the first period of time and the third period of time.

36. The system of claim 35 wherein the second signal changes from the second logic level to the first logic level after the third period of time.

37. The system of claim 36 wherein the second signal remains at the first logic level during the fourth period of time.

38. The system of claim 34 wherein the first logic level is a logic high level, and the second logic level is a logic low level.

39. The system of claim 28 wherein the first transistor terminal is coupled indirectly to the second controller terminal through a second resistor.

40. The system of claim 28, and further comprising:

a second transistor including a fourth transistor terminal, a fifth transistor terminal, and a sixth transistor terminal; and a third transistor including a seventh transistor terminal, an eighth transistor terminal, and a ninth transistor terminal;

wherein:

the system controller further includes a fourth controller terminal biased at a first voltage;

the fourth transistor terminal is coupled to the second controller terminal;

the fifth transistor terminal is coupled to the seventh transistor terminal;

the sixth transistor terminal is coupled to the fourth controller terminal;

the eighth transistor terminal is coupled to the first transistor terminal; and the ninth transistor terminal is biased at a second voltage.

41. The system of claim 40 wherein:

the sixth transistor terminal is coupled to the fourth controller terminal through a second resistor;

the seventh transistor terminal is coupled to the ninth transistor terminal through a third resistor; and the fourth transistor terminal is coupled to the sixth transistor terminal through a fourth resistor, and coupled to the first transistor terminal through a fifth resistor.

42. The system of claim 41 wherein the first voltage changes with time.

43. The system of claim 28 wherein the system controller further comprises:

a sensing component configured to receive the first signal and to generate a logic signal based at least in part on the first signal; and a control and driver component configured to detect the logic signal and to generate the second signal based at least in part on the logic signal.

44. The system of claim 28 wherein the second transistor terminal is coupled, directly, to the third controller terminal.

45. The system of claim 28 wherein the first resistor terminal is coupled, directly, to the second transistor terminal.

46. The system of claim 28 wherein the second resistor terminal is coupled, directly, to the third transistor terminal.

47. A system controller for dimming control, the system controller comprising:

a first controller terminal;

a second controller terminal; and a third controller terminal;

wherein the system controller is configured to:

generate a first signal at the first controller terminal based at least in part on an input signal;

generate a second signal at the second controller terminal based at least in part on the first signal; and output the second signal to a first transistor terminal of a transistor to change the transistor between a first condition and a second condition based at least in part on the second signal, a second transistor terminal of the transistor being coupled to the third controller terminal, a resistor being coupled between the second transistor terminal and a third transistor terminal of the transistor.

* * * * *